United States Patent [19]

McDougall

[11] Patent Number: 4,647,062

[45] Date of Patent: Mar. 3, 1987

[54] SKIING APPARATUS

[76] Inventor: David A. McDougall, P.O. Box 311, Ste Agathe, Quebec J8C 3C6, Canada

[21] Appl. No.: 570,042

[22] Filed: Nov. 10, 1983

[51] Int. Cl.[4] ..... A63C 5/00

[52] U.S. Cl. ..... 280/607

[58] Field of Search ..... 280/601, 607, 608, 618, 280/21 A

[56] References Cited

U.S. PATENT DOCUMENTS 3,921,994 11/1975 Locati ..... 280/607

4,449,735 5/1984 McDougall ..... 280/818

FOREIGN PATENT DOCUMENTS 2806883 2/1978 Fed. Rep. of Germany ..... 280/601

*Primary Examiner*—John J. Love

*Assistant Examiner*—Richard Camby

[57] ABSTRACT

A linkage connecting two runners and a platform, includes three link members in a pentagonal configuration to effect a progressive shift of weight onto the uphill runner from the downhill runner during rotation of the runners about the long axis of the platform.

1 Claim, 4 Drawing Figures

SKIING APPARATUS

BACKGROUND OF THE INVENTION

1. Field of the Invention

The present invention relates to an improvement in linkages, intended for use in alpine skis.

2. Description of the Prior Art

A linkage for maintaining parallel tilting motion of a pair of alpine skis is described in German Patent No. 28 06 883, Schumacher, 1978. The linkage includes two pairs of parallel links, a connector plate linking the two pairs of link ends, and a member linking two neighboring rods in order to limit the maximum separation of the two parallelogram pairs so that the distance between the skis does not exceed 40 cm. According to Schumacher, this linkage arrangement provides parallel edging of both skis, and the two skis are intended to be weighted equally through varying degrees of edging.

A linkage connecting two runners and a platform is described in the U.S. Pat. No. 4,449,735, McDougall, 1984. This linkage maintains a parallel attitude of the two runners and platform relative to each other and automatically effects a progressive shift of weight onto the uphill runner from the downhill runner during rotation of the runners about the long axis of the platform. This linkage facilitates control of the runners during skiing but is somewhat bulky, comprising at least five link members arranged in a twin-parallelogram configuration.

SUMMARY OF THE INVENTION

It is the aim of the present invention to provide a linkage that is similar in function to that described in U.S. Pat. No. 4,449,735, McDougall, 1984, but simpler in structure. The linkage of the present invention connects two runners and a platform and includes three link members arranged in a pentagonal configuration and slidably or pivotally interconnected. During rotation of the runners around the long axis of the platform, the linkage maintains a parallel or predetermined attitude of the two runners and platform relative to each other and effects a progressive shift of weight onto the uphill runner from the downhill runner.

The construction of the linkage in accordance with the present invention includes a first link member pivotally connecting the two runners at a point above the center of the width of each runner, a second link member pivotally connecting one runner and the platform, the horizontal distance between the two pivots of the second link being greater than half the distance between the centers of the two runners with the ski lying flat, a third link member similar to the second link but connecting the other runner and the platform, and the platform including a support surface adapted to bear on the firstlink member. The first link member includes a central, vertically oriented slot and a pin fixed above the slot. The platform includes a central pin which is slidably located in the slot of the first link member. The second and third links each include horizontally oriented slots in which the pin of the first link is slidably located.

During rotation of the runners about the long axis of the platform from the flat to an inclined attitude, the point of weightbearing contact between the platform and the first link member is shifted towards the uphill runner, corresponding to a shift in the fulcrum of a lever. The uphill runner rotates progressively less than the downhill runner relative to the platform, and weight is shifted to the uphill runner from the downhill runner. The attachment of the first link above the centers of the runners maintains the distance between the corresponding edges of the two runners constant during rotation of the runner about the platform. The pin of the first link member slides within the slot of either the second or third link members and maintains a parallel or predetermined attitude of one runner with respect to the other, and the pin fixed to the platform slides within the slot of the first link and maintains a parallel or predetermined attitude of the platform relative to the runners.

DESCRIPTION OF THE PREFERRED EMBODIMENT

Figure 1:
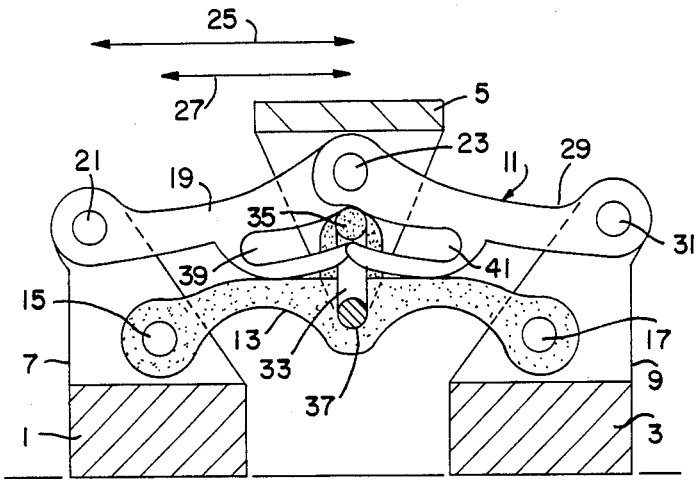
FIG. 1 is a cross-sectional view of the mid-section of the ski showing the linkage, runners and platform.
Figure 2:
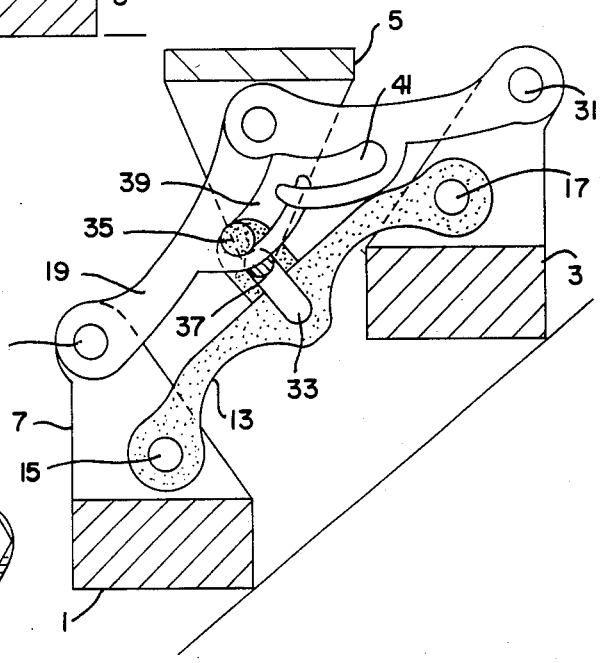
FIG. 2 is a cross-sectional view similar to FIG. 1 but showing the elements in an inclined position.

Referring to FIGS. 1 and 2, the ski comprises two runners 1 and 3, a platform 5 to which ski bindings may be mounted, mounting members 7 and 9 provided on the runners 1 and 3 respectively, and a linkage 11 connecting the mounting members 7 and 9 and the platform 5. The linkage 11 includes a first link member 13 pivotally connected to mounting members 7 and 9 by means of pivot pins 15 and 17 located above the middle of the width of each runner. A second link member 19 is pivotally connected to the mounting member 7 and the platform 5 by means of pivot pins 21 and 23 respectively. Referring to FIG. 1, the horizontal distance, as indicated by the length of line 25, between the pivot pins 21 and 23 of the second link member 19 must be greater than half the distance, as indicated by the length of line 27, between the pivot pins 15 and 17 of the first link member 13, to effect the desired shift of the fulcrum during rotation of the runners 1 and 3 about the platform 5. A third link member 29 is pivotally connected to the mounting member 9 and the platform 5 by means of pivot pins 31 and 23 respectively and is otherwise identical to the second link member 19. The second and third link members 19 and 29 overlap at their mutual pivot pin 23 in a tongue-and-groove fashion.

Referring to FIG. 1, the first link member 13 includes a centrally located, vertically aligned slot 33 and pin 35 fixed above the slot 33. The platform 5 includes a pin 37 fixed to the platform and slidably located within the slot 33 of the first link member 13. The second and third link members 19 and 29 each include horizontally aligned slots 39 and 41 respectively which overlap at their open medial ends and in which is slidably located the pin 35 of the first link member 13.

Referring to FIGS. 1 and 2, the linkage 11 is constructed in a manner such that the cross-sectional plane of the slot 33 of the first link member 13 is behind the plane of the second and third link members 19, 29, with the fixed pin 37 of the platform 5 being of sufficient length to project forward into the slot 33 of the first link member 13 but not so far as to impinge against the second and third link members 19 and 29. Similarly, the fixed pin 35 of the first link member 13 is of sufficient length to project forward into either slot 39 or 41 of the second and third link members 19 and 29 but not so far as to impinge against the front wall of the platform 5. The linkage 11 is assembled by first positioning the slot 33 of the first link member 13 over the fixed pin 37 of the platform 5, then positioning the second and third link members 19 and 29 in front of the first link member and finally attaching the three link members to the mounting members 7 and 9 and the platform 5 by means of the removable pivot pins 15, 17, 21, 23 and 31, which could be in the form of bolts.

During rotation of the runners 1 and 3 about the long axis of the platform 5, as shown in FIG. 2, the pin 35 slides within the slot 39 and maintains a parallel attitude of one runner with respect to the other runner, or a predetermined attitude depending on the shape of the slots 39 and 41. Likewise, the pin 37 slides within the slot 33 and maintains a parallel or predetermined attitude of the platform 5 relative to the runners.

Figure 3:
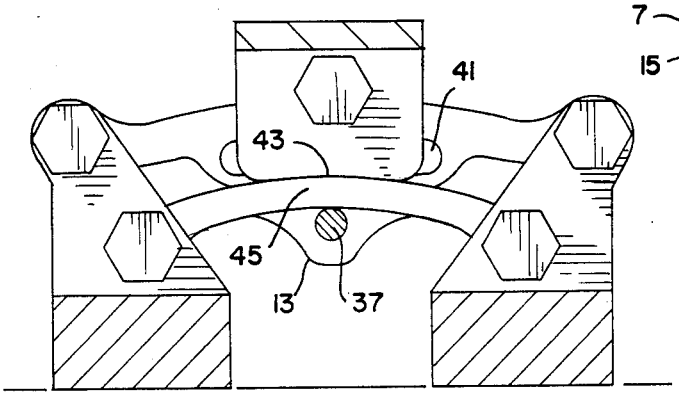
FIG. 3 is a cross-sectional view taken in front of that shown in FIG. 1.
Figure 4:
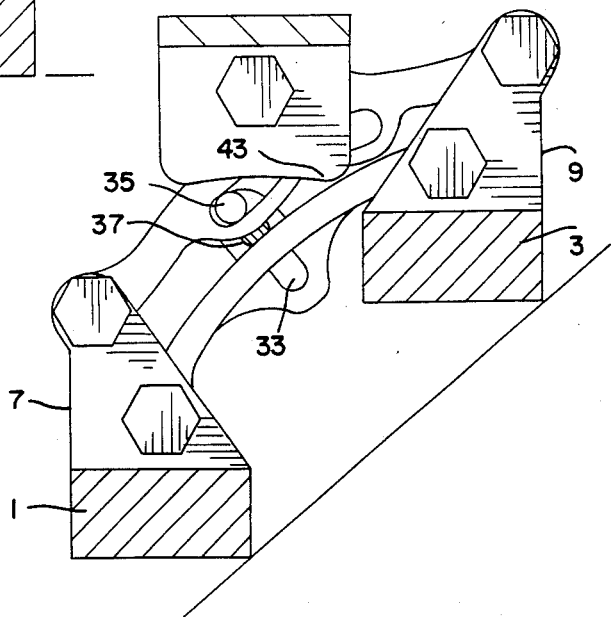
FIG. 4 is a cross-sectional view similar to FIG. 3 showing the inclined appearance.

Referring to FIGS. 3 and 4, the platform 5 has a fulcrum surface 43 which bears on an extension 45 of the first link member 13. During rotation of the runners 1 and 3 about the long axis of the platform 5, the contact point of the extension 45 and the fulcrum surface 43 is shifted towards the uphill runner.

I claim:

1. A linkage connects two runners and a platform and controls the rotation of the runners about the long axis of the platform, said linkage including three link members pivotally connected at their respective lateral ends to two mounting members by means of removable pins, such as bolts, each mounting member being bonded to its respective runner, said link members including a first link member extending between the two runners and pivotally connecting the mounting members above the center of the width of each runner, said first link member including a centrally located, vertically aligned slot, a pin fixed above the slot, and a superior surface adapted to bear against a corresponding inferior surface of the platform, said link members including a second link member extending between one runner and the platform and pivotally connecting the respective mounting member beyond the middle of the width of the runner and the middle of the width of the platform by means of removable pins, the horizontal distance between the two pivots of the second link being greater than half the distance between the two pivots of the first link member, measured with the runners flat, said second link member including a horizontally oriented slot, open at the medial end, in which the fixed pin of the first link member is slidably located, said link members including a third link member similar to the second link member except that it extends between the other runner and the platform and its medial end overlaps the medial end of the second link member in a tongue-and groove manner so that the second and third link members are pivotally connected to the platform by the same removable pin, said platform including a fixed central pin which is slidably located in the slot of the first link member, said linkage being constructed with the cross-sectional plane of the slot of the first link member lying behind the plane of the second and third link members, the fixed pin of the platform extending forward into the slot of the first link member, and the fixed pin of the first link member extending forward into the overlapping slots of the second and third link members, said linkage being assembled by first positioning the slot of the first link member relative to the fixed pin of the platform, then positioning the second and third link members and attaching the three link members to the mounting members and platform by means of the five removable pins, the functional arrangement of said linkage being such that during rotation of the runners about the long axis of the platform, the fixed pin of the first link member slides within the slot of the second or third link members, thereby maintaining a parallel or predetermined attitude of one runner relative to the other runner, the fixed pin of the platform slides within the slot of the first link member, thereby maintaining a parallel or predetermined attitude of the platform relative to the runners, and the contact between corresponding bearing surfaces of the first link member and the platform is shifted towards the uphill runner.

* * * * *